US006528953B1

(12) United States Patent
Pearson et al.

(10) Patent No.: US 6,528,953 B1
(45) Date of Patent: Mar. 4, 2003

(54) AMALGAM RETAINER

(75) Inventors: Nicolas Pearson, Drummondville (CA); Joseph V. Lima, Salem, MA (US); David C. Wentzel, Newmarket, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/963,044

(22) Filed: Sep. 25, 2001

(51) Int. Cl.[7] ..... H05B 41/16

(52) U.S. Cl. ..... 315/248; 315/344; 315/58; 313/490; 313/483; 313/484

(58) Field of Search ..... 315/57, 58, 70, 315/71, 248, 338, 344, 267; 313/483, 484, 485, 490, 550, 552, 564, 565

(56) References Cited

U.S. PATENT DOCUMENTS 5,412,289 A * 5/1995 Thomas et al. ..... 313/160
5,434,482 A * 7/1995 Borowiec et al. ..... 313/490
5,500,567 A * 3/1996 Wilson et al. ..... 313/490
5,629,581 A * 5/1997 Belle et al. ..... 313/318.12
5,834,905 A 11/1998 Godyak et al. ..... 315/248
6,175,197 B1 1/2001 Kling ..... 315/248

* cited by examiner

*Primary Examiner*—Haissa Philogene
(74) *Attorney, Agent, or Firm*—Carlos S. Bessone

(57) ABSTRACT

An arc discharge lamp comprises an arc chamber having an amalgam tip attached to and communicating with it. The communication comprises a narrow tubular extension that penetrates the amalgam tip for a distance less than the depth of the tip. An amalgam that includes bismuth is contained within the amalgam tip. This construction allows operation of the lamp in any position and prevents the bismuth in the amalgam from penetrating the lamp and poisoning the phosphor.

5 Claims, 1 Drawing Sheet

AMALGAM RETAINER

TECHNICAL FIELD

This invention relates to an amalgam retainer for an arc discharge lamp and more particularly to an amalgam retainer for an electrodeless lamp.

BACKGROUND ART

Many arc discharge lamps rely for operation on the presence of mercury in the arc stream. The mercury is present, when the lamp is not operating, as elemental mercury or as a solid or liquid amalgam. In some types of lamps, particularly electrodeless fluorescent lamps such as those shown in U.S. Pat. Nos. 6,175,197 and 5,834,905, it is important to keep the solid or liquid amalgam from settling within the arc environment where it can cause changes in the lumen output and the lumen-temperature performance of the lamp. This is particularly true in those instances where the amalgam includes bismuth.

DISCLOSURE OF INVENTION

It is, therefore, an object of this invention to obviate the disadvantages of the prior art.

It is another object of the invention to enhance to operation arc discharge lamps.

It is yet another object of the invention to enhance the operation and life of electrodeless fluorescent lamps.

These objects are accomplished, in one aspect of the invention by providing an arc discharge lamp that has an arc chamber with an amalgam tip attached to and communicating with the arc chamber through an elongated narrow tube which projects into the amalgam tip. An amalgam is contained within the amalgam tip. The amalgam tip contains sufficient volume to contain the amalgam when in a liquid or solid state and the narrow tube permits the necessary mercury vapor to enter the arc chamber. The construction allows operation of the lamp in any position, including one with the amalgam tip uppermost.

BEST MODE FOR CARRYING OUT THE INVENTION

For a better understanding of the present invention, together with other and further objects, advantages and capabilities thereof reference is made to the following disclosure and appended claims in conjunction with the above-described drawings.

Figure 1:
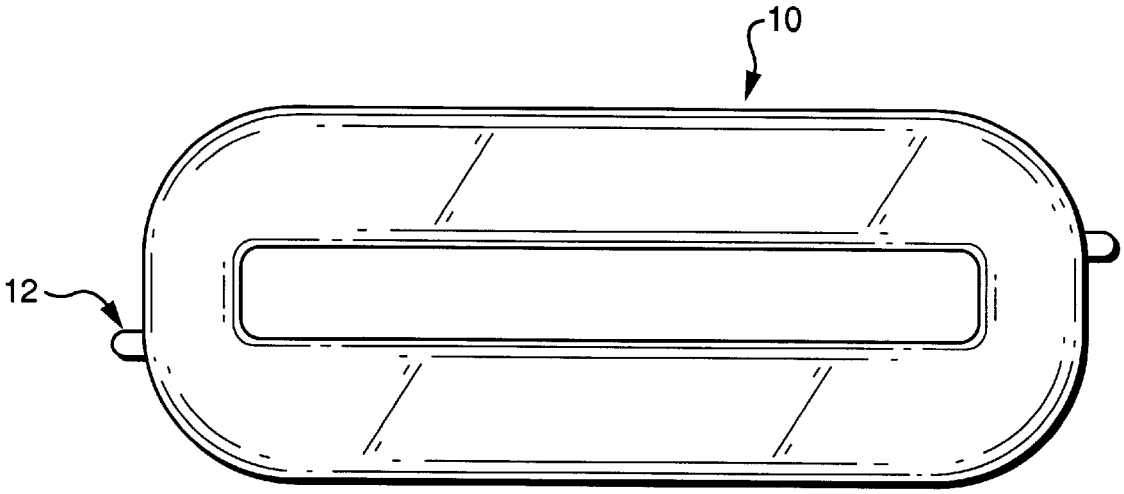
FIG. 1 is a plan view of an electrodeless lamp.
Figure 2:
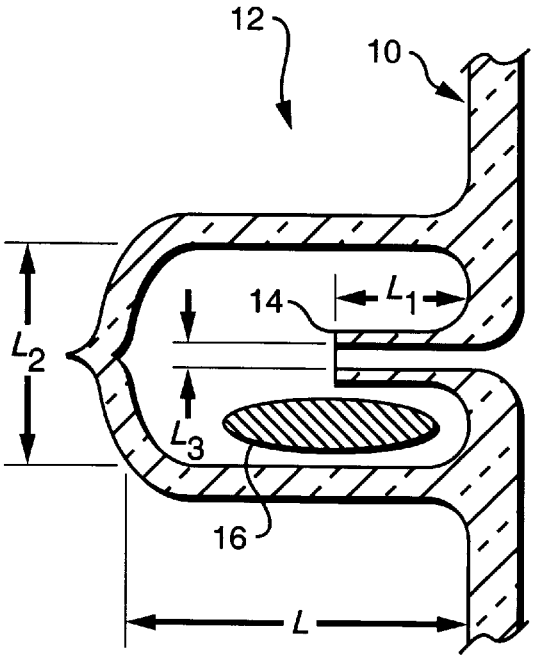
FIG. 2 is a sectional view of an amalgam tip in accordance with the invention.

Referring now to the drawings with greater particularity, there is shown in FIG. 1 an electrodeless lamp 10 with the external electrical couplings omitted for purposes of clarity. Such a lamp can be of the type shown in the U.S. patents mentioned above, that is, a low pressure, electrodeless fluorescent lamp. The lamp 10 has an amalgam tip 12 attached to and communicating with the interior of the lamp 10 through an elongated narrow tube 14 and containing an amalgam 16 that contains bismuth. The tube 14 is shown most clearly in FIG. 2.

In a preferred embodiment of the invention, the tip 12 has a depth L and the tube 14 has a length $L_1$ that is about 40% of L. The tip 12 preferably has an inside diameter $L_2$ that is about 80 to 100% of L and the tube 14 has an inside diameter $L_3$ that is preferably 10 to 20% of L.

In a specific embodiment, the tip 12 can have an internal depth of 10 mm and an internal diameter of 8 to 10 mm. Tube 14 has an internal length of 4 mm and an internal diameter of 1 to 2 mm. This construction provides ample volume to contain the liquid or solid amalgam in any position in which the lamp may be operated, including a mounting where the amalgam tip 12 would be uppermost. When the lamp is operated, the tube 14 easily permits the necessary mercury vapor to enter the arc chamber. To ensure that the mercury is heated to a temperature sufficiently high to achieve the necessary vapor state, a thermal bridge between the transformer core and the amalgam can be provided, as taught in the above-mentioned U.S. Pat. No. 6,175,197.

While there have been shown and described what are at present considered to be the preferred embodiments of the invention, it will be apparent to those skilled in the art that various changes and modification can be made herein without departing from the scope of the invention as defined by the appended claims.

What is claimed is:

1. An arc discharge lamp comprising:

an arc chamber;

an amalgam tip attached to and communicating with said arc chamber through a narrow tubular extension which penetrates said amalgam tip for a distance less than the depth of said tip; and an amalgam contained within said amalgam tip.

2. The arc discharge lamp of claim 1 wherein said amalgam includes bismuth.

3. The arc discharge lamp of claim 2 wherein said arc discharge lamp is an electrodeless lamp.

4. The arc discharge lamp of claim 1 wherein said amalgam tip has a given depth and said tubular extension has a length that is about 40% of said depth.

5. The arc discharge lamp of claim 4 wherein said amalgam tip has an inside diameter that is from 80 to 100% of said given depth and said tubular extension has an inside diameter that is 10 to 20% of said given depth.

* * * * *